US011910855B1

(12) United States Patent
Michitti

(10) Patent No.: US 11,910,855 B1
(45) Date of Patent: Feb. 27, 2024

(54) ARTICLE OF CLOTHING

(71) Applicant: Alexia M. Michitti, Vestal, NY (US)

(72) Inventor: Alexia M. Michitti, Vestal, NY (US)

(73) Assignee: EM13RACE, LLC, Vestal, NY (US)

( * ) Notice: Subject to any disclaimer, the term of this patent is extended or adjusted under 35 U.S.C. 154(b) by 0 days.

(21) Appl. No.: 18/130,037

(22) Filed: Apr. 3, 2023

(51) Int. Cl.

| | |
|---|---|
| ***A41D 15/00*** | (2006.01) |
| ***A41D 27/10*** | (2006.01) |
| ***A41D 1/06*** | (2006.01) |
| ***A41B 1/10*** | (2006.01) |

(52) U.S. Cl.
CPC ..... *A41D 15/002* (2013.01); *A41B 1/10* (2013.01); *A41D 1/06* (2013.01); *A41D 27/10* (2013.01); *A41B 2300/22* (2013.01)

(58) Field of Classification Search
CPC ... A41D 15/002; A41D 27/10; A41B 2300/22
USPC ..... 2/269
See application file for complete search history.

(56) References Cited

U.S. PATENT DOCUMENTS

| | | | | |
|---|---|---|---|---|
| 5,097,537 | A * | 3/1992 | Ewing | A41B 11/003 2/241 |
| 5,182,812 | A * | 2/1993 | Goldsby | A61H 36/00 2/84 |
| 5,191,659 | A * | 3/1993 | Backus | A41D 13/129 2/76 |
| 5,343,564 | A * | 9/1994 | Reynolds | A41D 13/001 2/70 |
| 5,504,944 | A * | 4/1996 | Bromer | A41B 7/00 2/93 |
| 5,774,892 | A * | 7/1998 | Tisdale | A41D 15/00 2/69 |
| 5,890,231 | A * | 4/1999 | Ueda | A41D 1/08 2/125 |
| 6,374,414 | B1 * | 4/2002 | Collier | A41D 27/10 2/908 |
| D815,799 | S * | 4/2018 | Huynh | D2/742 |
| 10,617,161 | B2 * | 4/2020 | Walrich | A41D 15/005 |
| 2009/0019616 | A1 * | 1/2009 | Smith | A41D 13/02 2/269 |

* cited by examiner

*Primary Examiner* — Gloria M Hale
(74) *Attorney, Agent, or Firm* — Jong Patent Firm; Cheng Ning Jong; Tracy P. Jong

(57) ABSTRACT

An article of clothing adapted for use by a wearer having a torso, the article of clothing including a body configured for covering at least a portion of the torso; a pair of openings, each opening disposed on a side of the body; and at least one sleeve extending from at least one of the pair of openings to form at least one extension, where the degree of extension of a first sleeve of the at least one sleeve from one of the pair of openings is different from the degree of extension from a second sleeve of the at least one sleeve from the other one of the pair of openings.

18 Claims, 15 Drawing Sheets

ARTICLE OF CLOTHING

BACKGROUND OF THE INVENTION

1. The Field of the Invention

The present invention relates to an article of clothing. More specifically, the present invention is directed to an article of clothing suitable for a limb-deficit individual.

2. Background Art

Commonly and commercially-available mass-produced articles of clothing, e.g., a long-sleeved shirt or a pair of long pants are made with both sleeves having similar or identical lengths. Therefore, a limb-deficit individual, e.g., an amputee may find the articles of clothing made for individuals with full limbs difficult to put on due to the use of a full sleeve even when the abnormal limb no longer has the same dexterity as the other normal limb. Further, if the article of clothing is used without an artificial limb having been put on, the limb-deficit portion of the individual will still be covered with a full sleeve, leaving excessive materials of the sleeve to cover the reduced limb, therefore making the sleeve not properly fitting. The use of poorly-fitted articles of clothing can cause parts of the affected sleeve to lay loose and it can get inadvertently caught while the wearer is moving around or while being transported, e.g., in a wheelchair. The poorly-fitted clothing may also present itself as non-aesthetically pleasing or unkempt. Rather than presenting oneself with a "skinny sleeve" as a non-supported or a partially-supported sleeve (due to a partial limb) tend to appear skinny, some limb-deficit individuals would instead opt for short sleeved clothing even when the climate surrounding the individuals is not suitable for such clothing.

There exists a need for an article of clothing suitable for use by a limb-deficit individual where the article of clothing relieves the individual from potential impediments caused by the individual having to use an article of clothing created for a fully-limbed individual.

SUMMARY OF THE INVENTION

In accordance with the present invention, there is provided an article of clothing adapted for use by a wearer having a torso, the article of clothing including:

(a) a body configured for covering at least a portion of the torso;

(b) a pair of openings, each of the openings disposed on a side of the body; and (c) at least one sleeve extending from at least one of the pair of openings to form at least one extension, wherein the degree of extension of a first sleeve of the at least one sleeve from one of said pair of openings is different from the degree of extension from a second sleeve of the at least one sleeve from the other one of the pair of openings.

In one embodiment, the at least a portion of the torso is the upper torso. In one embodiment, the article of clothing further includes an elastic band configured to be coupled to an opening of the less extended sleeve of the first sleeve and the second sleeve. In one embodiment, the article of clothing further includes a zipper configured to allow an opening of the less extended sleeve of the first sleeve and the second sleeve to be adjusted and a closure mechanism to removably secure the zipper in a desired state. In one embodiment, the article of clothing is a shirt, a blouse, a sweater, a jacket or any combinations thereof. In one embodiment, the degree of extension does not include an extension. In one embodiment, the degree of extension is upper arm-length extension, elbow-length extension or lower arm-length extension. In one embodiment, the upper arm-length extension is characterized by an extension having a ratio of the length of the upper arm-length extension over a full-sleeve length of about $1/8$ to about $7/24$. In one embodiment, the elbow-length extension is characterized by an extension having a ratio of the length of the elbow-length extension over a full-sleeve length of about $7/24$ to about $11/24$. In one embodiment, the lower arm-length extension is characterized by an extension having a ratio of the length of the lower arm-length extension over a full-sleeve length of about $5/6$ to about $23/24$. In one embodiment, the at least a portion of the torso is the lower torso. In one embodiment, the article of clothing is a pair of pants, a pair of sweatpants or a combination thereof. In one embodiment, the degree of extension is upper leg-length extension, knee-length extension or lower leg-length extension. In one embodiment, the upper leg-length extension is characterized by an extension having a ratio of the length of the upper leg-length extension over a full-sleeve length of about $1/5$ to about $11/35$. In one embodiment, the knee-length extension is characterized by an extension having a ratio of the length of the knee-length extension over a full-sleeve length of about $12/35$ to about $16/35$. In one embodiment, the lower leg-length extension is characterized by an extension having a ratio of the length of the lower leg-length extension over a full-sleeve length of about $28/35$ to about $32/35$. In one embodiment, the at least one sleeve is a ruched sleeve. In one embodiment, the at least one sleeve further includes a slit disposed on a cuff of the at least one sleeve.

An object of the present invention is to provide an article of clothing which fits a limb-deficit individual properly.

Another object of the present invention is to provide an article of clothing having a sleeve that does not need to be rolled up or bunched up during use.

Another object of the present invention is to provide an article of clothing which fits a limb-deficit individual properly such that potential hazards due to improperly fit article of clothing can be avoided.

Another object of the present invention is to provide an article of clothing which fits a limb-deficit individual properly to provide an aesthetically pleasing appearance.

Whereas there may be many embodiments of the present invention, each embodiment may meet one or more of the foregoing recited objects in any combination. It is not intended that each embodiment will necessarily meet each objective. Thus, having broadly outlined the more important features of the present invention in order that the detailed description thereof may be better understood, and that the present contribution to the art may be better appreciated, there are, of course, additional features of the present invention that will be described herein and will form a part of the subject matter of this specification.

BRIEF DESCRIPTION OF THE DRAWINGS

In order that the manner in which the above-recited and other advantages and objects of the invention are obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

PARTS LIST

Figure 1:
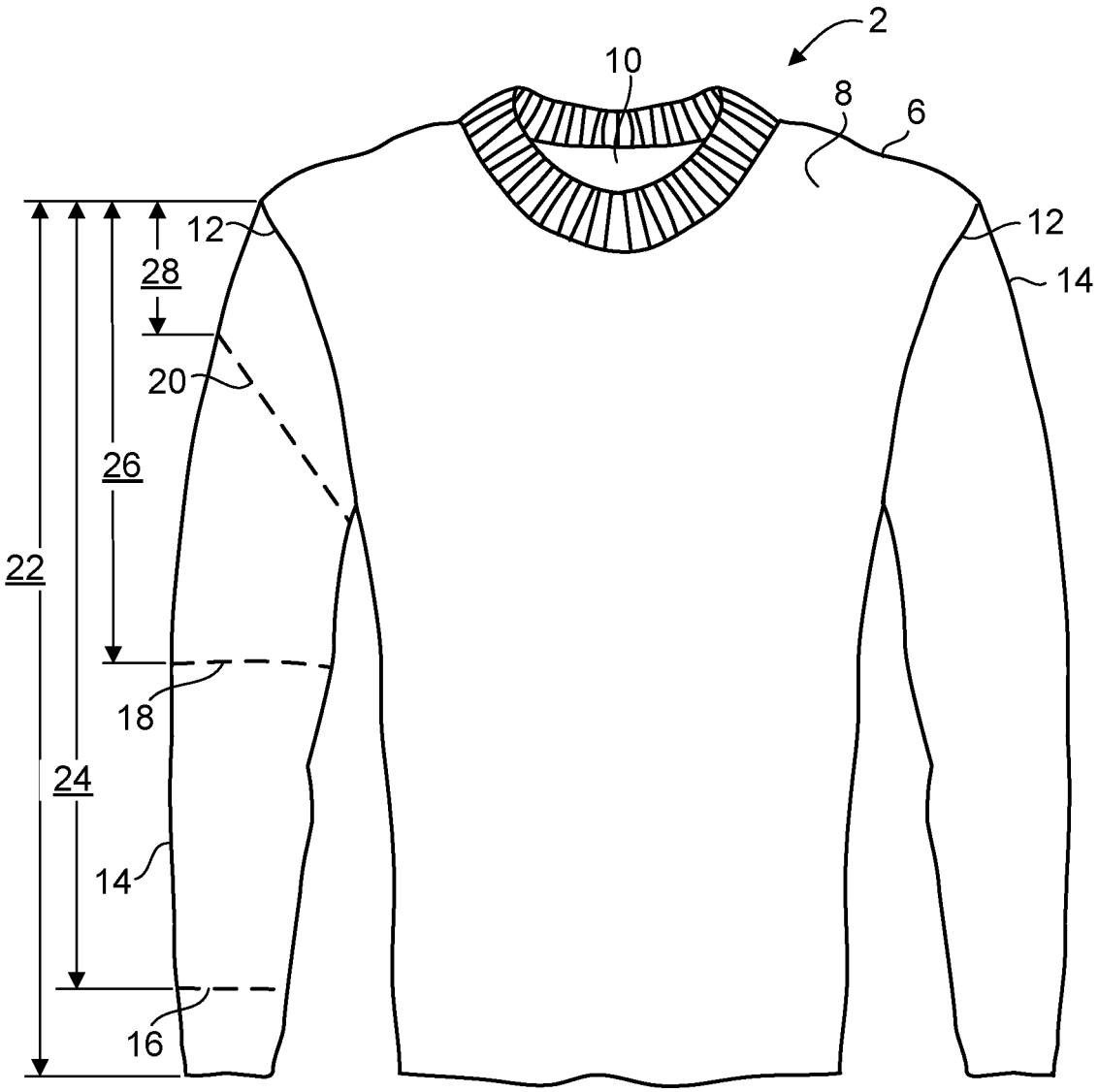
FIG. 1 is a diagram depicting various configurations of a present article of clothing for the upper torso of an individual.

2—article of clothing for upper torso
4—article of clothing for lower torso
6—body
8—front sheet
10—rear sheet
12—opening
14—sleeve
16—cuff at lower arm-length
18—cuff at elbow-length
20—cuff at upper arm-length
22—full length of sleeve
24—lower-arm length
26—elbow-length
28—upper arm-length
30—cuff at lower leg-length
32—cuff at knee-length
34—cuff at upper leg-length
36—full length of sleeve
38—lower leg-length
40—knee-length
42—upper leg-length
44—residual arm/leg or stump
46—artificial limb
48—arm
50—leg
52—crinkled portion of sleeve
54—zipper
56—hook and loop pair
58—direction of forces applied to attach hook and loop pair
60—direction of forces applied to attach hook and loop pair
62—elastic band
64—cuff
66—cuff
68—strap

PARTICULAR ADVANTAGES OF THE INVENTION

Limb-deficit individuals are often faced with challenges that arise due to the lack of more appropriately-fitting everyday items, e.g., articles of clothing. The present article of clothing is an article of clothing which fits a limb-deficit individual better such that a limb-deficit no longer needs to make compromises as the disability makes fitting in normal articles of clothing made for individuals without disability awkward and/or uncomfortable.

The present article of clothing is suitable for a limb-deficit individual that is using an artificial limb or without an artificial limb. With a sleeve that is shorter than a full-length sleeve, there is no excess sleeve material which needs to be tucked away when an artificial limb is disposed in place to at least partially support the sleeve. Without an artificial limb disposed in place, there is little to no excess sleeve material that needs to be tucked away for safety and aesthetics, e.g., while preparing food over hot surfaces or carrying out other daily activities.

In several embodiments, a closure mechanism is provided to further secure a cuff against an artificial limb to not only provide a neat appearance of the sleeve around the artificial limb but also to reduce exposure of the user's limb to the element such that the user's limb can be kept warm with or without an artificial limb attached.

DETAILED DESCRIPTION OF A PREFERRED EMBODIMENT

The term "about" is used herein to mean approximately, roughly, around, or in the region of. When the term "about" is used in conjunction with a numerical range, it modifies that range by extending the boundaries above and below the numerical values set forth. In general, the term "about" is used herein to modify a numerical value above and below the stated value by a variance of 20 percent up or down (higher or lower).

As used herein, the term "limb-deficit" is used to refer to an individual's disability involving at least a portion of a limb, e.g., an arm or a leg. For instance, a limb-deficit individual may lack a portion of a limb, e.g., a hand, a lower arm, an upper arm, a foot, a lower leg and/or an upper leg due to birth defect or an amputation required for a medical condition and therefore may require an artificial limb, e.g., a prosthetic arm or leg.

Conventional clothing for female and male is characterized by a body portion configured to cover a portion of the torso while having a pair of openings from which a pair of sleeves extend to cover upper limbs (or arms) or lower limbs (or legs). All conventional mass-produced sleeved upper wear, e.g., shirts, blouses, jackets, and sweaters, come with sleeves of the same length to cover arms or legs. For long-sleeved upper wear, full-length sleeves are provided. For those with physical disabilities, e.g., from amputations, various simply daily tasks requiring one to fold up the sleeves to avoid getting the cuffs wet or soiled, could be challenging to overcome, especially when the dexterity of the individuals has been severely compromised. Depending on the severity of one's amputation, a sleeve is commonly gathered in a folded position and bunched up to various degrees to avoid getting it soiled or having an excess sleeve portion flop around. Some amputees use prosthetic limbs to compensate for the lost limb. These prosthetic limbs are designed to be the same length as the lost limb and therefore can fill the gap in sleeve length. Even so, some prosthetic limbs are not made to fill the gap in a manner that would make the sleeve appear normal. A present article of clothing is configured to be suitable for a limb-deficit individual that is using an artificial limb or without an artificial limb. A limb-deficit individual can work around the challenges that are presented by their limb-deficiency more easily using the present article of clothing as he or she can feel comfortable and confident in the clothing.

Figure 2:
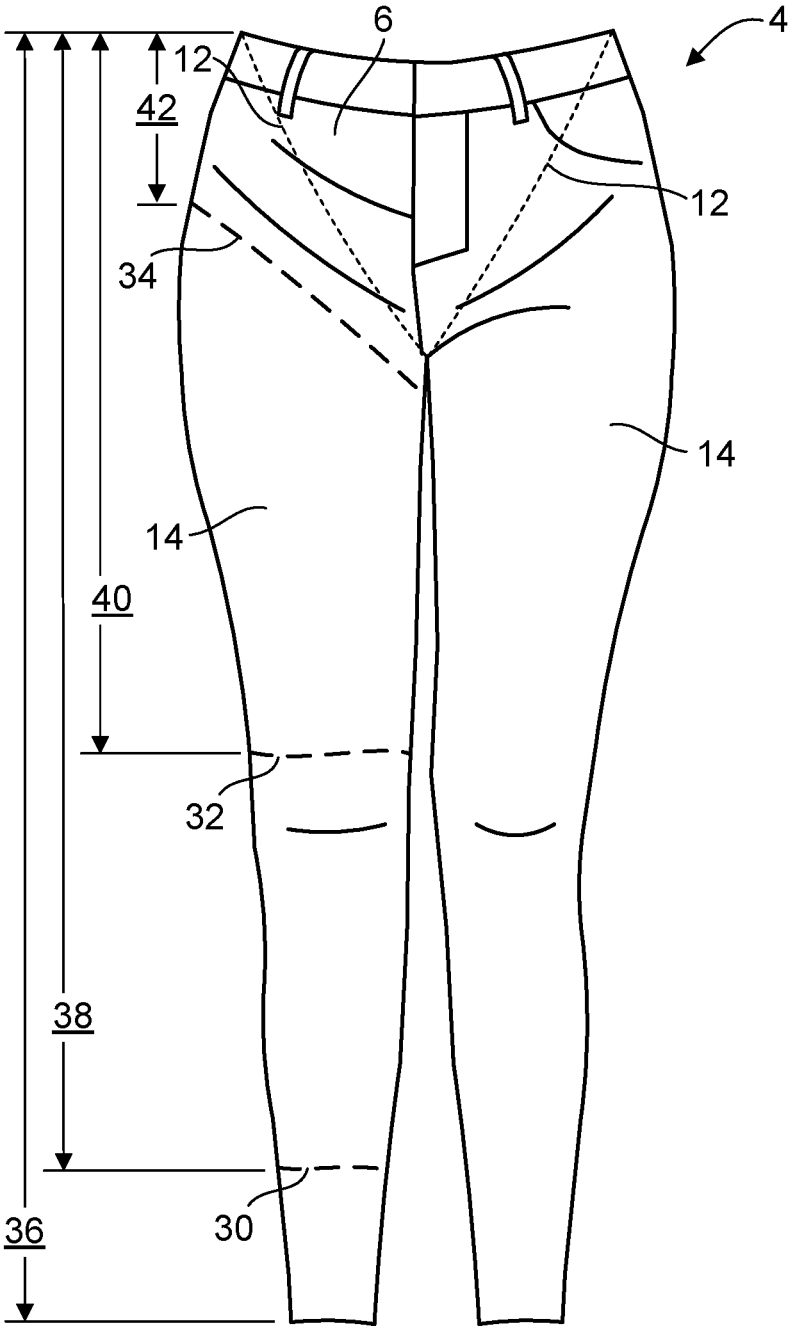
FIG. 2 is a diagram depicting various configurations of a present article of clothing for the lower torso of an individual.

FIG. 1 is a diagram depicting various configurations of a present article of clothing 2, e.g., a sweatshirt, for the upper torso of an individual. FIG. 2 is a diagram depicting various configurations of a present article of clothing 4, e.g., a pair of pants, for the lower torso of an individual. The article of clothing 2, 4 includes a body 6 configured for covering at least a portion of the torso, a pair of openings 12 where each of the openings 12 disposed on a side of the body 6 and at least one sleeve 14 extending from at least one of the pair of openings 12 to form at least one extension. The body 6 includes a front sheet 8 and a rear sheet 10 to cover the upper torse. The degree of extension of a first sleeve 14 from one of the pair of openings 12 is different from the degree of extension from a second sleeve 14 of the at least one sleeve from the other one of the pair of openings 12. Referring to FIG. 1, a right sleeve having its cuff disposed at various levels that are not at the full-length 22 of sleeve, all of which are depicted to reveal various embodiments of the present article of clothing. A full-length right sleeve is depicted for reference in connection to the various embodiments. In one embodiment, the degree of extension is upper arm-length extension shown with a cuff 20 disposed at upper arm-length. In another embodiment, the degree of extension is elbow-length extension shown with a cuff 18 disposed at elbow-length. In another embodiment, the degree of extension is lower arm-length extension shown with a cuff 16 disposed at lower arm-length. In one embodiment, the degree of extension does not include an extension, i.e., there is no sleeve material emanating from the opening 12 for the affected arm. This configuration is useful when the wearer has lost the entire upper arm, leaving no portions of an upper arm to cover. In one embodiment, the upper arm-length extension is characterized by an extension having a ratio of the length 28 of the upper arm-length extension over a full-sleeve length of about $1/8$ to about $7/24$. In one embodiment, the elbow-length extension is characterized by an extension having a ratio of the length 26 of the elbow-length extension over a full-sleeve length of about $7/24$ to about $11/24$. In one embodiment, the lower arm-length extension is characterized by an extension having a ratio of the length 24 of the lower arm-length extension over a full-sleeve length of about $5/6$ to about $23/24$. Applicant discovered that with a sleeve that is shorter than a full-length sleeve, there is no excess sleeve material which needs to be tucked away when an artificial limb is disposed in place to at least partially support the sleeve. Without an artificial limb disposed in place, there is little to no excess sleeve material that needs to be tucked away for safety and aesthetics, e.g., while preparing food or carrying out other daily activities. In one embodiment, the article of clothing is a shirt, a blouse, a sweater, a jacket or any combinations thereof. The shirt includes, but not limited to, a buttoned-down shirt or a dress shirt that features buttons on the collar area to fasten it down to the shirt. The shirt allows for a more polished and structured look, making it suitable for formal occasions or professional settings. The shirt typically has a flat or slightly curved collar, full-length sleeves, and a button-down front. It is often made from cotton or a blend of cotton and synthetic materials and comes in a variety of colors and patterns. In one embodiment, at least one of a full-length sleeve and a reduced-length sleeve disclosed elsewhere herein is a ruched sleeve to provide a T-shirt dressier and with slightly increased structural strength although it is provided at a final length that meets the ratios disclosed elsewhere herein.

Referring to FIG. 2, a right sleeve having its cuff disposed at various levels that are not at the full-length 36 of sleeve, all of which are depicted to reveal various embodiments of the present article of clothing. A full-length right sleeve is depicted for reference in connection to the various embodiments. In one embodiment, the degree of extension is upper leg-length extension shown with a cuff 34 disposed at upper leg-length. In another embodiment, the degree of extension is knee-length extension shown with a cuff 32 disposed at elbow-length. In another embodiment, the degree of extension is lower leg-length extension shown with a cuff 30 disposed at lower arm-length. In one embodiment, the degree of extension does not include an extension, i.e., there is no sleeve material emanating from the opening 12 for the affected leg. This configuration is useful when the wearer has lost the entire upper leg, leaving no portions of an upper leg to cover. In one embodiment, the upper leg-length extension is characterized by an extension having a ratio of the length 42 of the upper leg-length extension over a full-sleeve length of about $1/5$ to about $11/35$. In one embodiment, the knee-length extension is characterized by an extension having a ratio of the length 40 of the knee-length extension over a full-sleeve length of about $12/35$ to about $16/35$. In one embodiment, the lower leg-length extension is characterized by an extension having a ratio of the length 38 of the lower leg-length extension over a full-sleeve length of about $28/35$ to about $32/35$. Applicant discovered that with a sleeve that is shorter than a full-length sleeve, there is no excess sleeve material which needs to be tucked away when an artificial limb is disposed in place to at least partially support the sleeve. Without an artificial limb disposed in place, there is little to no excess sleeve material that needs to be tucked away for safety and aesthetics. Although only a right limb or sleeve is shown to illustrate the features of the present article of clothing, these features can of course be applied to a left limb or sleeve as well.

Figure 3:
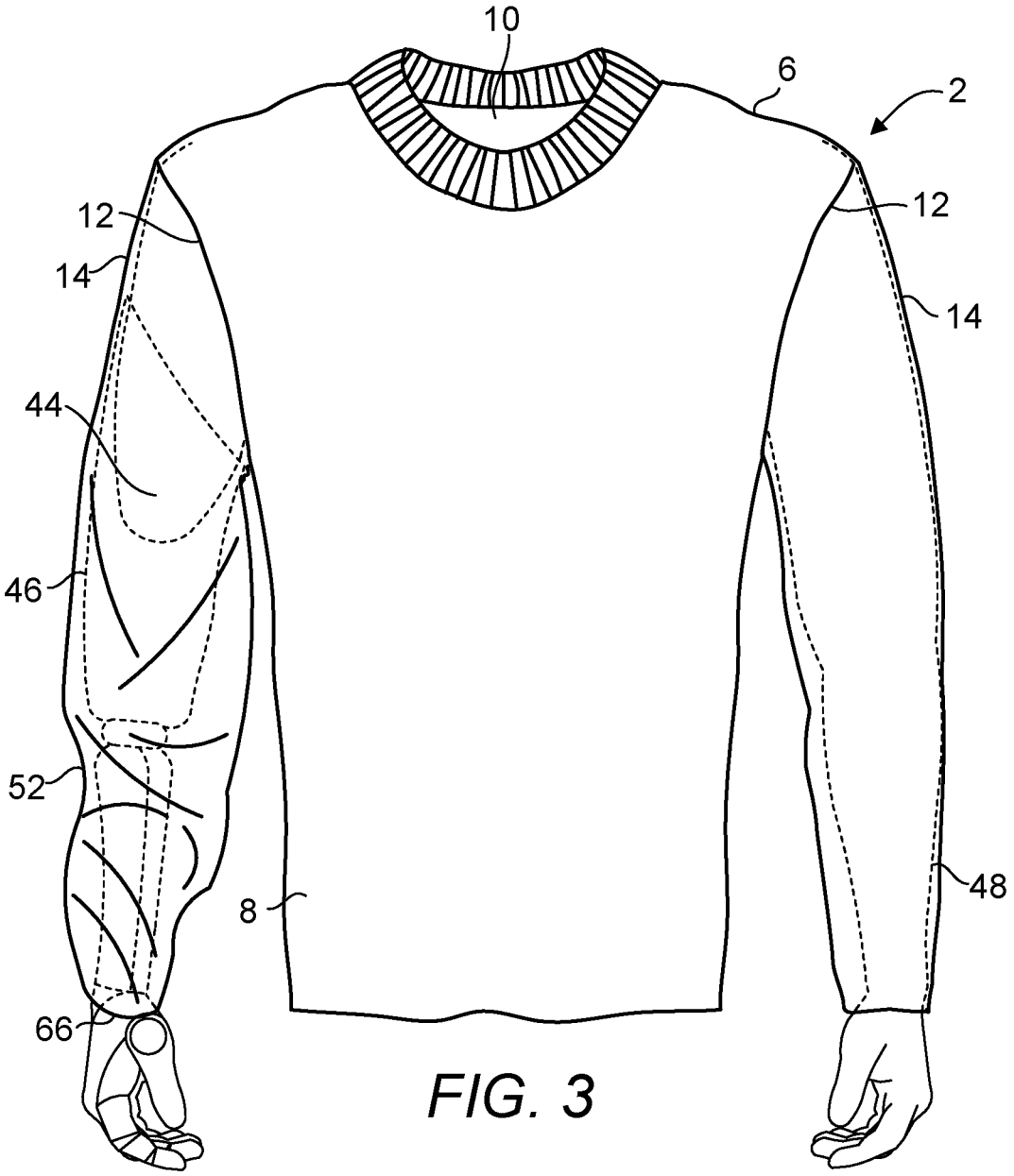
FIG. 3 is a diagram depicting disadvantages of a prior art article of clothing used on an upper torso of a limb-deficit individual.
Figure 4:
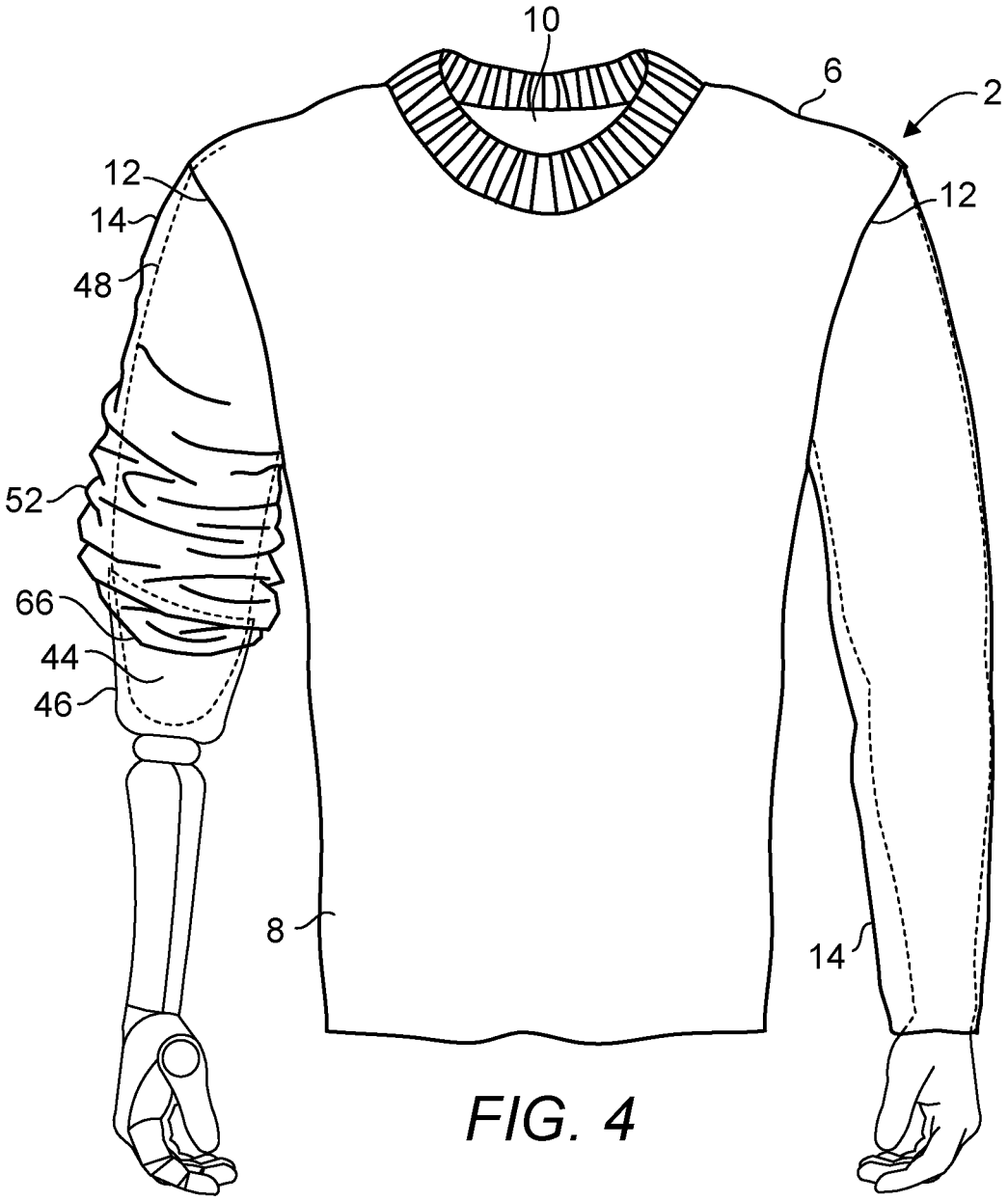
FIG. 4 is a diagram depicting disadvantages of a prior art article of clothing used on an upper torso of a limb-deficit individual.

FIG. 3 is a diagram depicting disadvantages of a prior art article of clothing used on an upper torso of a limb-deficit individual. FIG. 4 is a diagram depicting disadvantages of a prior art article of clothing used on an upper torso of a limb-deficit individual. It shall be noted that as the artificial limb 46 attached to the stump 44 of the wearer's limb-deficit arm 48 does not fill in the gap left by the lost arm as sleeve portions 52 of the lower arm area appear crinkled and the cuff 66 of the full-length sleeve drops below the normal position had there been a normal arm to fill the interior space of the sleeve. Often times, this causes the wearer to attempt to retract and bunch up the sleeve to move the cuff 66 of the sleeve out of the way as shown in FIG. 4 to reduce interference with daily tasks. It shall be noted that the bunched-up sleeve is bunched up into a bulky form, with the cuff ended up in a position substantially at a receptacle edge of the artificial limb as it is a position which provides sufficient friction to the bunched up sleeve such that it will stay in a final length until it tends to loosen and falls back to its original final length with the cuff at the user's wrist.

Figure 5:
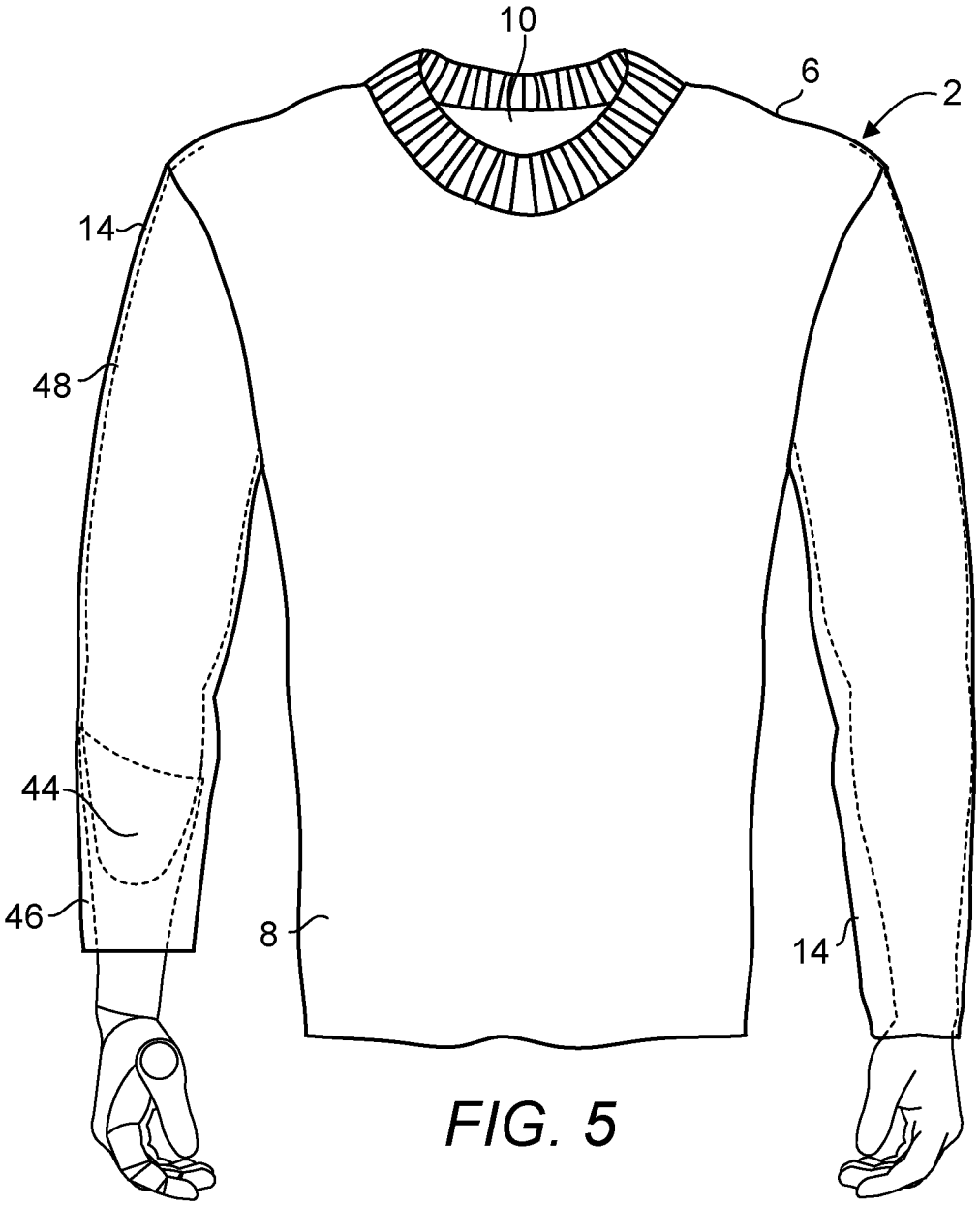
FIG. 5 is a diagram depicting a present article of clothing used on an upper torso of a limb-deficit individual.

FIG. 5 is a diagram depicting a present article of clothing used on an upper torso of a limb-deficit individual. The partially transparent view of the lost arm shows a stump 44 of the arm at the lower arm, its approximate location and the artificial limb 46 in use with the arm. Referring back to both FIGS. 1 and 5, the shortened sleeve 14 extends to a cuff level corresponding to cuff 16 of FIG. 1. It shall be noted that, at this cuff position, the sleeve leaves little excess material and its user will most likely not require that the sleeve be pulled up.

Figure 6:
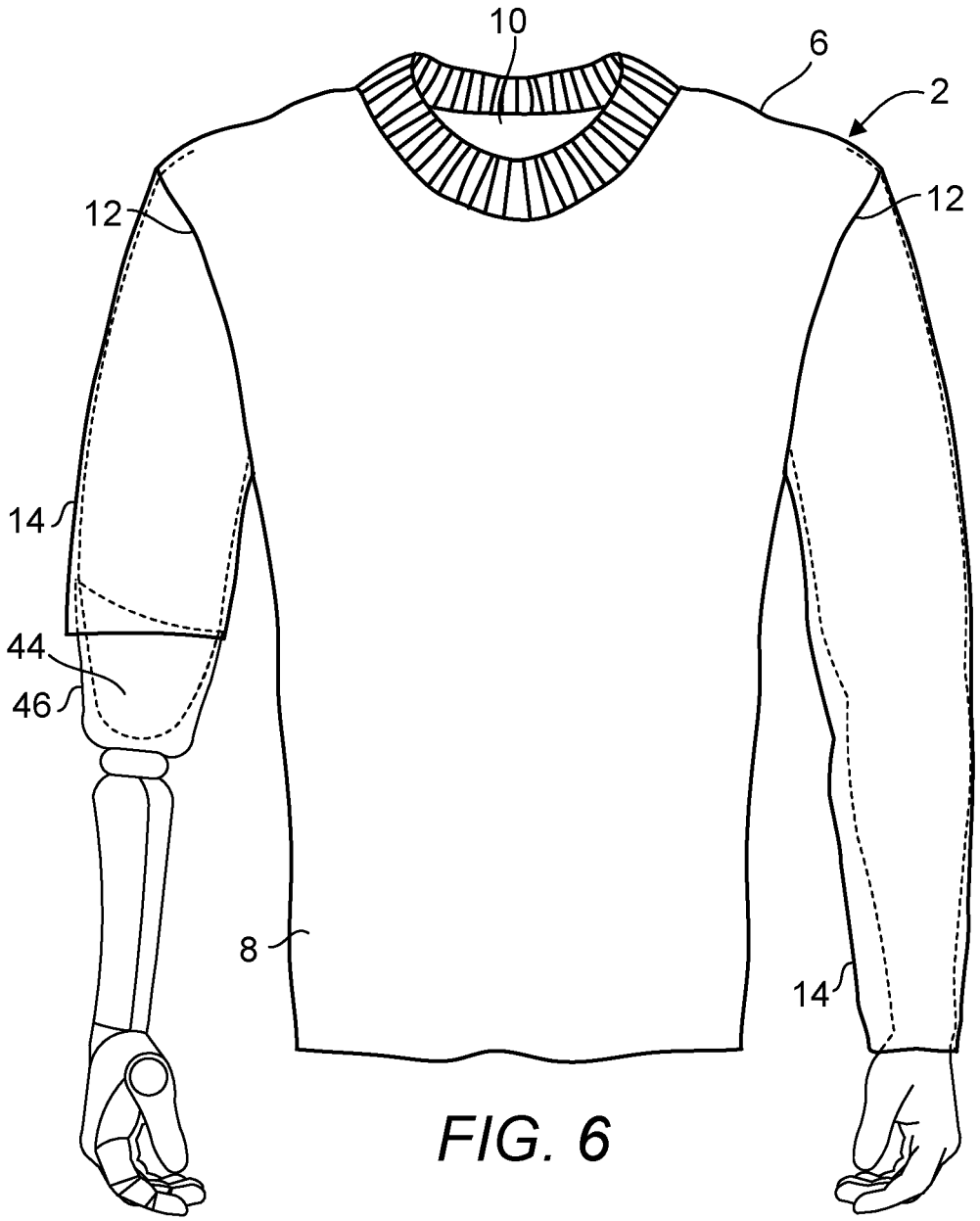
FIG. 6 is a diagram depicting a present article of clothing used on an upper torso of a limb-deficit individual.

FIG. 6 is a diagram depicting a present article of clothing used on an upper torso of a limb-deficit individual. The partially transparent view of the lost arm shows a stump 44 of the arm at around the elbow, its approximate location and the artificial limb 46 in use with the arm. Referring back to both FIGS. 1 and 6, the shortened sleeve 14 extends to a cuff level corresponding to cuff 18 of FIG. 1. Again, at this cuff position, the sleeve also leaves little excess material and its user will most likely not require that the sleeve be pulled up.

Figure 7:
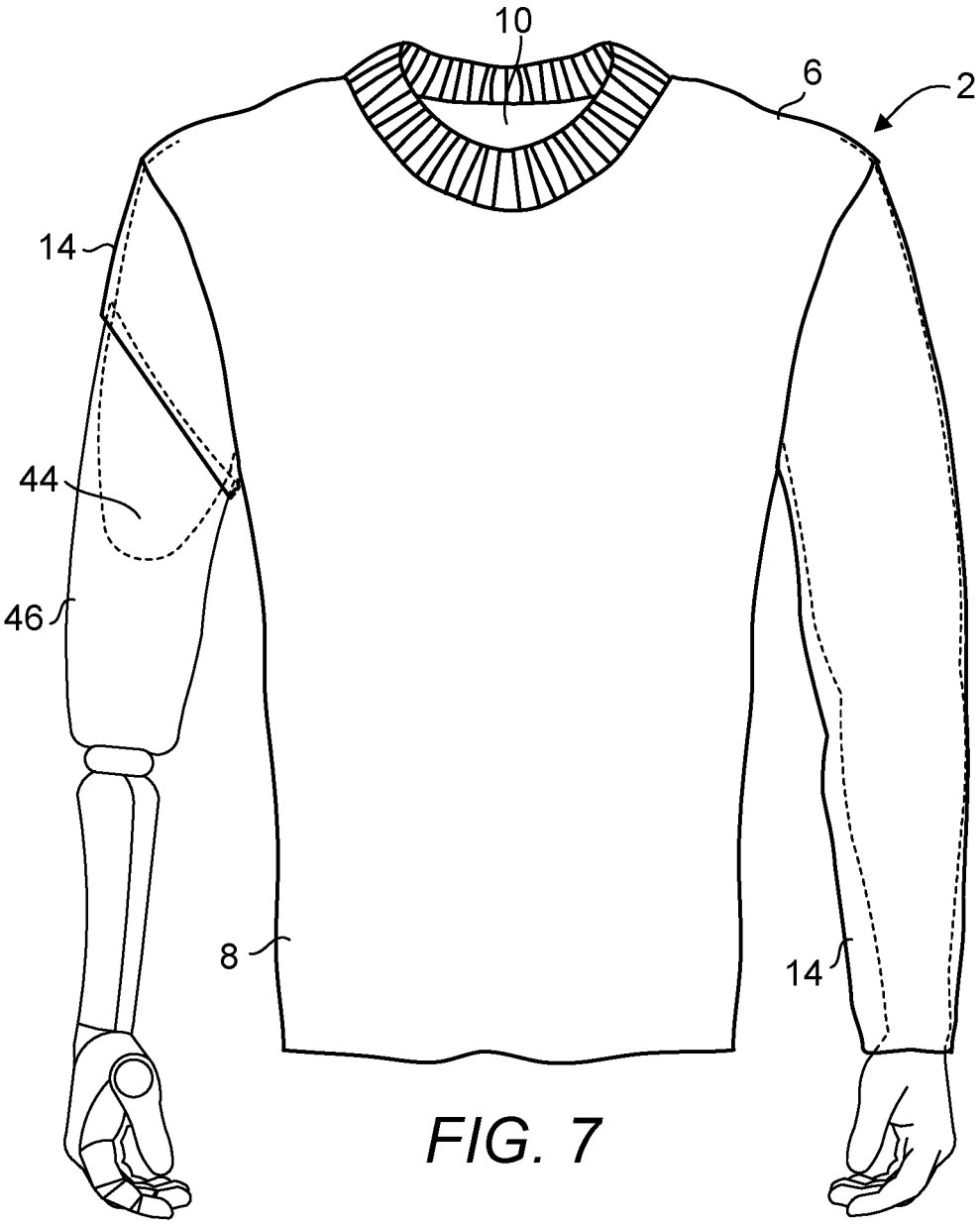
FIG. 7 is a diagram depicting a present article of clothing used on an upper torso of a limb-deficit individual.

FIG. 7 is a diagram depicting a present article of clothing used on an upper torso of a limb-deficit individual. The partially transparent view of the lost arm shows a stump 44 of the arm at the upper arm, its approximate location and the artificial limb 46 in use with the arm. Referring back to both FIGS. 1 and 7, the shortened sleeve 14 extends to a cuff level corresponding to cuff 20 of FIG. 1. Again, at this cuff position, the sleeve also leaves little excess material and its user will most likely not pull up the sleeve.

Figure 8:
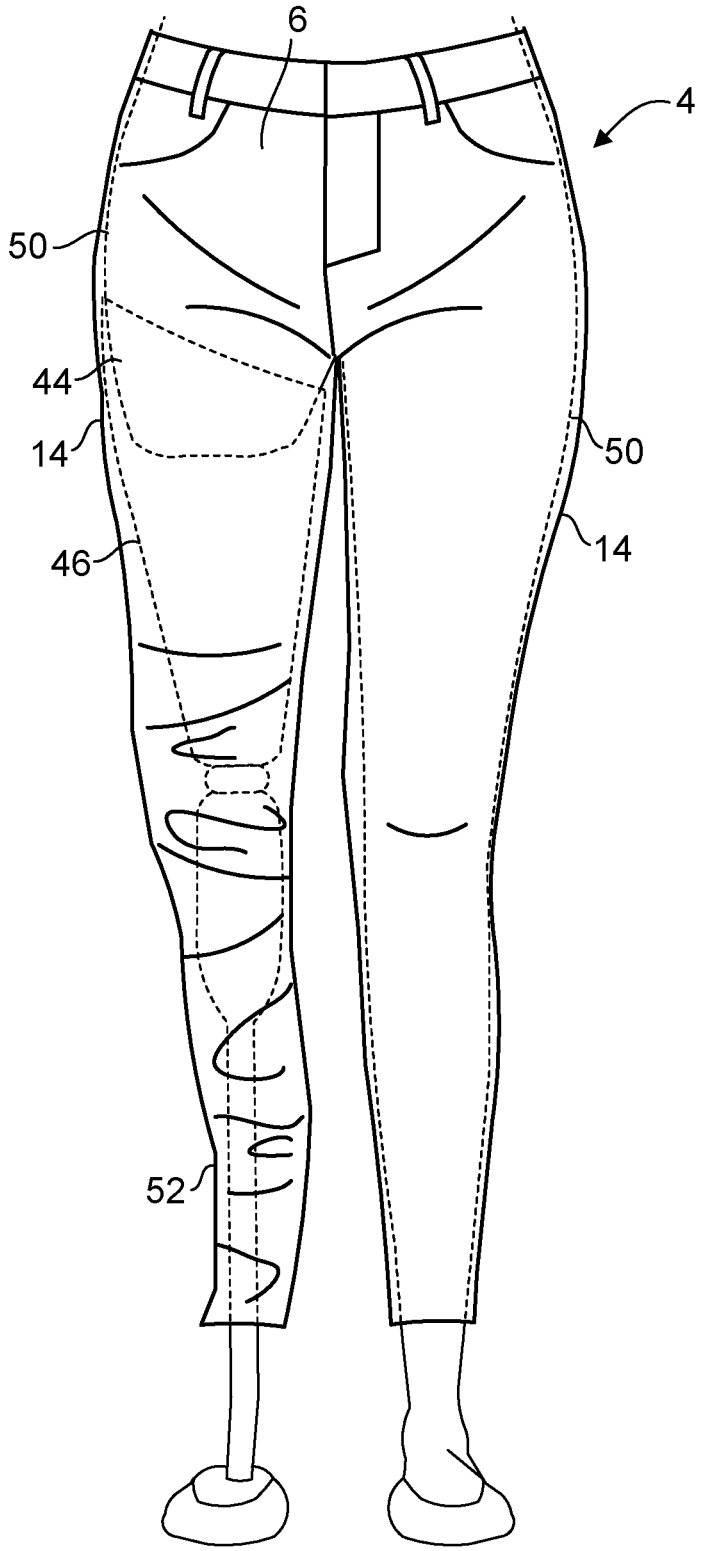
FIG. 8 is a diagram depicting disadvantages of a prior art article of clothing used on a lower torso of a limb-deficit individual.
Figure 9:
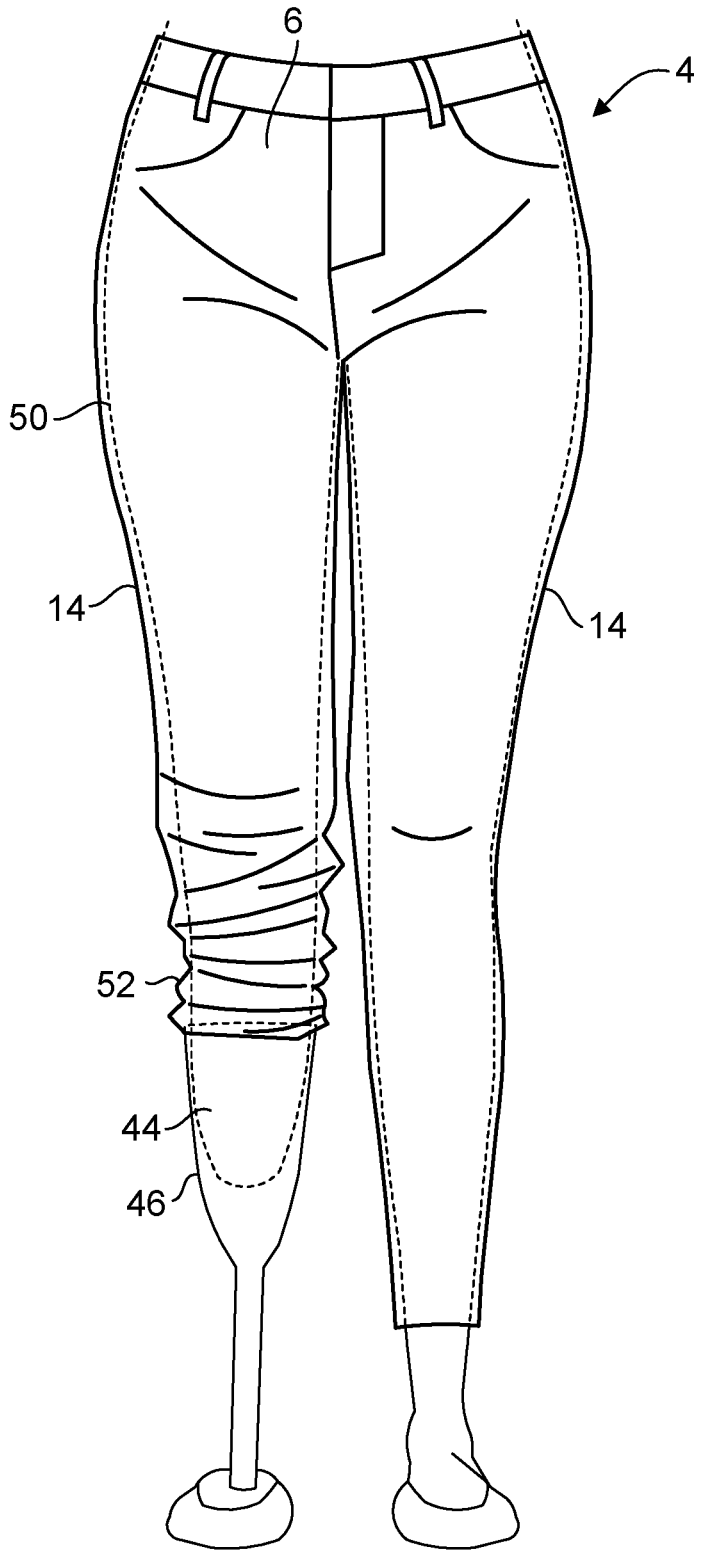
FIG. 9 is a diagram depicting disadvantages of a prior art article of clothing used on a lower torso of a limb-deficit individual.

FIG. 8 is a diagram depicting disadvantages of a prior art article of clothing used on a lower torso of a limb-deficit individual. It shall be noted that as the artificial limb 46 attached to the stump 44 of the wearer's limb-deficit leg 50 does not fill in the gap left by the lost leg as sleeve portions 52 of the lower arm area appear crinkled and the cuff 66 of the full-length sleeve drops below the normal position had there been a normal leg to fill the interior space of the sleeve. Often times, this causes the wearer to attempt to retract and bunch up the sleeve to move the cuff 66 of the sleeve out of the way as shown in FIG. 9 to reduce interference with daily tasks. FIG. 9 is a diagram depicting disadvantages of a prior art article of clothing used on a lower torso of a limb-deficit individual. Again, it shall be noted that the bunched-up sleeve is bunched up into a bulky form, with the cuff ended up in a position substantially at a receptacle edge of the artificial limb as it is a position which provides sufficient friction to the bunched up sleeve such that it will stay in a final length until it tends to loosen and falls back to its original final length with the cuff at the user's ankle.

Figure 10:
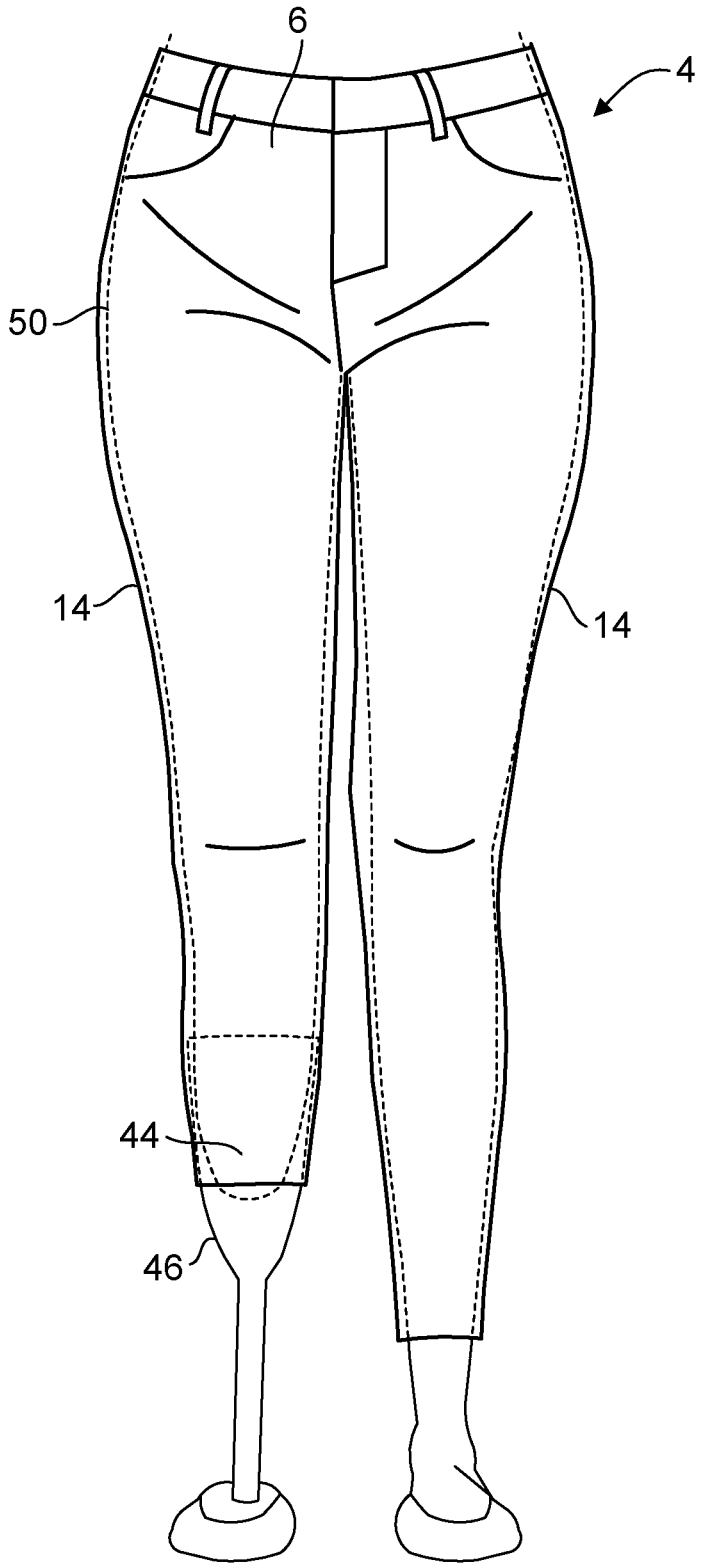
FIG. 10 is a diagram depicting a present article of clothing used on a lower torso of a limb-deficit individual.

FIG. 10 is a diagram depicting a present article of clothing used on a lower torso of a limb-deficit individual. The partially transparent view of the lost leg shows a stump 44 of the leg at the lower leg, its approximate location and the artificial limb 46 in use with the leg. Referring back to both FIGS. 2 and 10, the shortened sleeve 14 extends to a cuff level corresponding to cuff 30 of FIG. 2. It shall be noted that, at this cuff position, the sleeve leaves little excess material and its user will most likely not require that the sleeve be pulled up.

Figure 11:
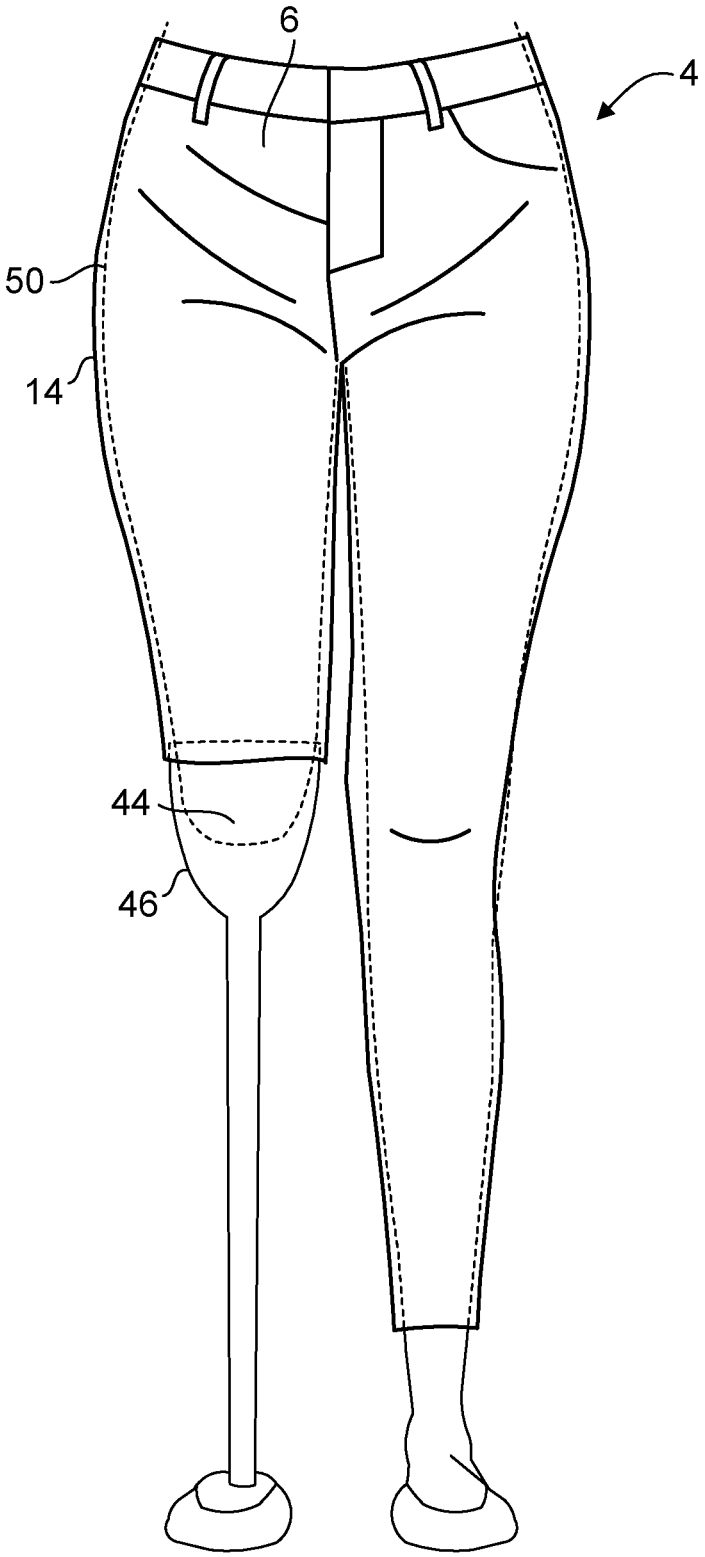
FIG. 11 is a diagram depicting a present article of clothing used on a lower torso of a limb-deficit individual.

FIG. 11 is a diagram depicting a present article of clothing used on a lower torso of a limb-deficit individual. The partially transparent view of the lost leg shows a stump 44 of the leg at around the knee, its approximate location and the artificial limb 46 in use with the leg. Referring back to both FIGS. 2 and 11, the shortened sleeve 14 extends to a cuff level corresponding to cuff 32 of FIG. 2. Again, at this cuff position, the sleeve also leaves little excess material and its user will most likely not require that the sleeve be pulled up.

Figure 12:
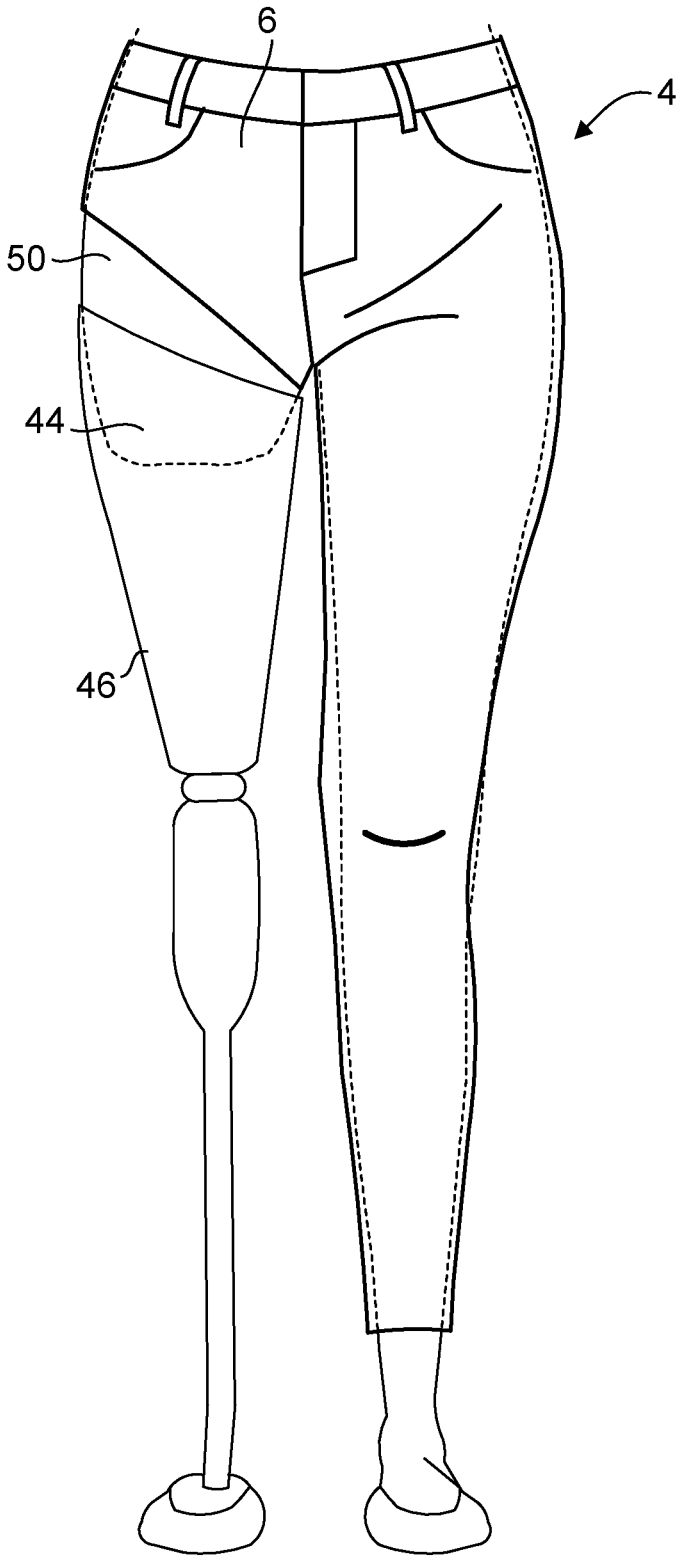
FIG. 12 is a diagram depicting a present article of clothing used on a lower torso of a limb-deficit individual.

FIG. 12 is a diagram depicting a present article of clothing used on a lower torso of a limb-deficit individual. The partially transparent view of the lost leg shows a stump 44 of the leg at the upper leg, its approximate location and the artificial limb 46 in use with the leg. Referring back to both FIGS. 2 and 12, the shortened sleeve 14 extends to a cuff level corresponding to cuff 34 of FIG. 2. Again, at this cuff position, the sleeve also leaves little excess material and its user will most likely not pull up the sleeve.

Figure 13:
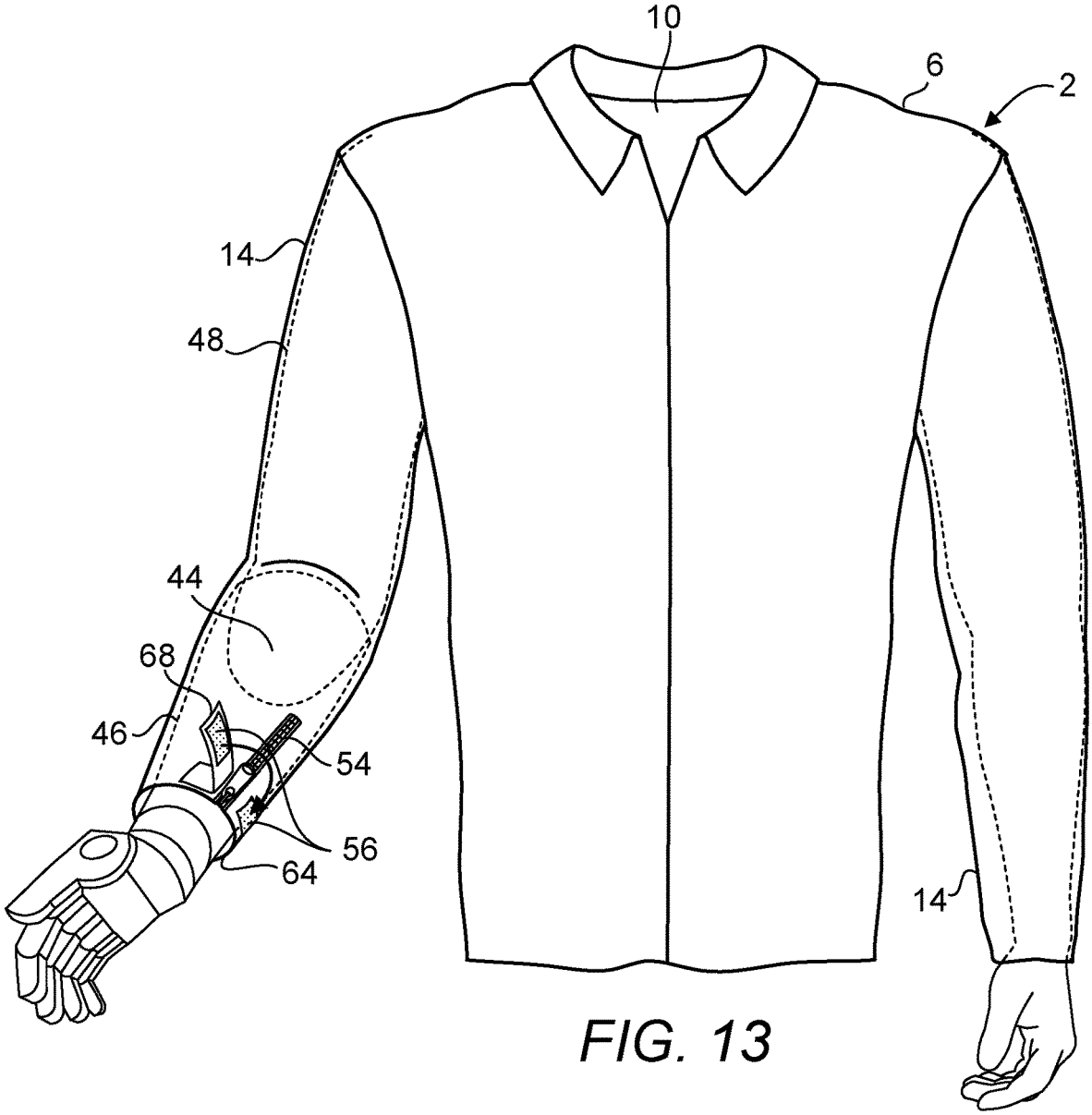
FIG. 13 is a diagram depicting a present article of clothing used on an upper torso of a limb-deficit individual where the cuff of a sleeve further includes a closure mechanism.

FIG. 13 is a diagram depicting a present article of clothing, e.g., a jacket, used on an upper torso of a limb-deficit individual where the cuff 64 of a sleeve further includes a closure mechanism. Here, the article of clothing 2 further includes a zipper 54 configured to allow an opening of the less extended sleeve 14 to be adjusted and a closure mechanism to removably secure the zipper in a desired state. A zipper 54 with its fully open position disposed at the cuff 64 is configured to allow room for the artificial limb 46 to be inserted without having the struggle of fitting it through the sleeve as a whole. Further, a strap 68 disposed on the cuff 64 is configured to allow adjustment of the size of the effective perimeter of the cuff 64 by using a hook and loop attachment pieces 56. The sleeve of the article of clothing is preferably constructed from a material that is sufficiently rigid to facilitate use of the zipper 54 with only one hand. Again, the hook and loop pair also make final securement of the cuff easy for a one-handed operation. In one embodiment not shown, instead of a zipper, a slit is disposed along the opening on which the zipper is installed to facilitate insertion of the artificial limb 46. In another embodiment, a second slit is provided along the same perimeter of the cuff such that the two slits are symmetrically disposed on the cuff.

Figure 14:
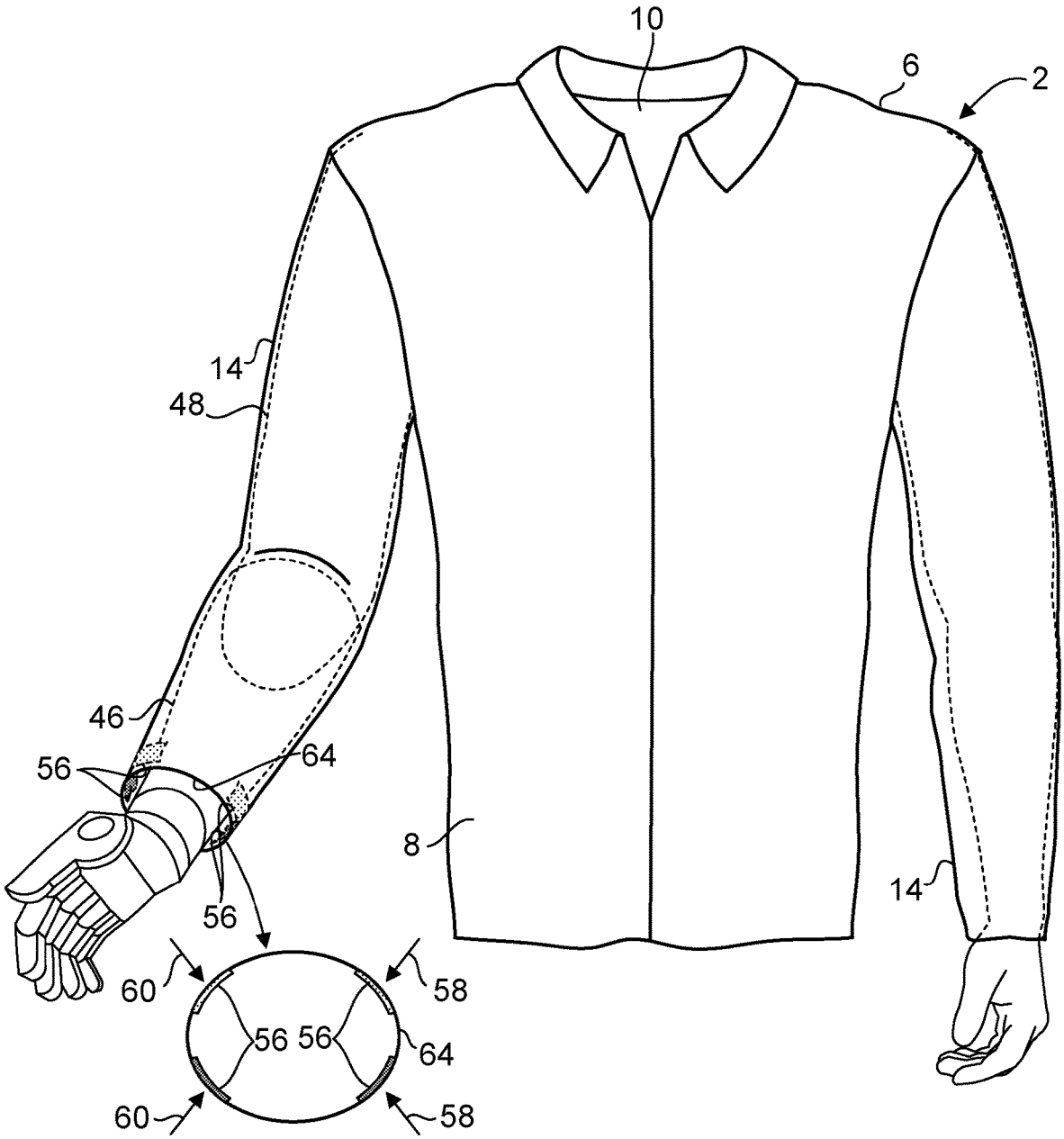
FIG. 14 is a diagram depicting a present article of clothing used on an upper torso of a limb-deficit individual where the cuff of a sleeve further includes yet another closure mechanism.

FIG. 14 is a diagram depicting a present article of clothing used on an upper torso of a limb-deficit individual where the cuff 64 of a sleeve further includes yet another closure mechanism. Here, two pairs 56 of hook and loop materials are opposingly disposed about a periphery of the cuff 64. To apply the hook and loop pair 56s to tighten a cuff 64, the user simply apply forces, e.g., using fingers of the able hand in directions 58 and/or 60. A simple pull of the cuff 64 against the artificial limb 46 releases one or more pairs 56 of the hook and loop materials, enlarging the opening of the cuff 64 again to allow the sleeve 14 to be removed from the artificial limb 46.

Figure 15:
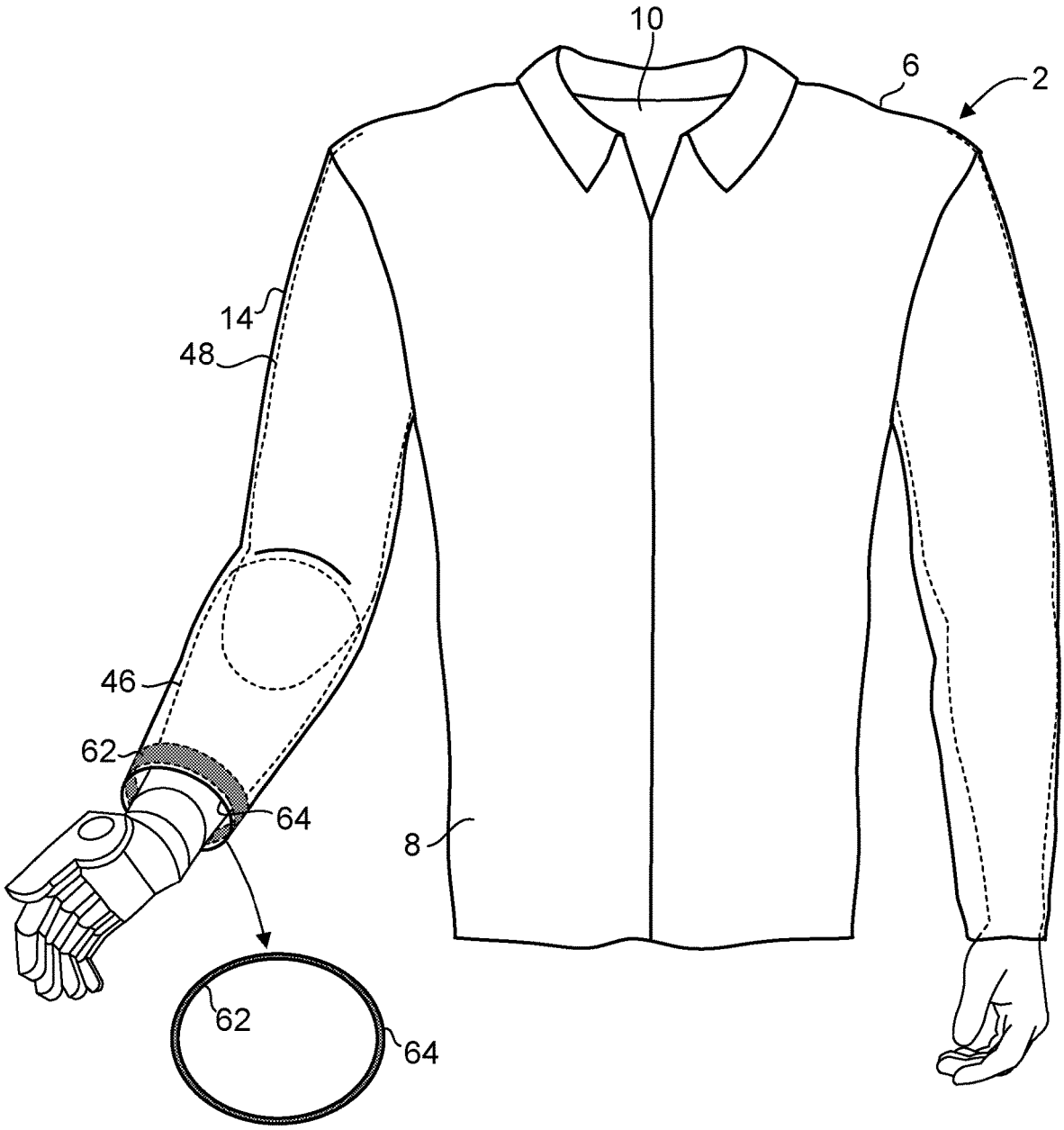
FIG. 15 is a diagram depicting a present article of clothing used on an upper torso of a limb-deficit individual where the cuff of a sleeve further includes yet another closure mechanism.

FIG. 15 is a diagram depicting a present article of clothing used on an upper torso of a limb-deficit individual where the cuff of a sleeve further includes yet another closure mechanism. Here, the article of clothing 2 further includes an elastic band 62 configured to be coupled to an opening of the less extended sleeve 14. Within the sleeve cuff 64 of the shortened side of the shirt 2, there is disposed an elastic band 62 useful for allowing flexible expansion and contraction of the cuff to encircle an artificial limb 46 of any conceivable size. In another embodiment not shown, a shortened sleeve 14 is ribbed with ribs or elastic bands which are spaced from one another starting from substantially the cuff 64 of the sleeve 14, with each band substantially encircling a cross-sectional periphery of the sleeve 14. Although the closure mechanisms of FIGS. 13-15 are shown coupled to a sleeve for an article of clothing 2 for the upper torso, the similar mechanisms may also be used on sleeves of an article of clothing 2 for the lower torso.

The detailed description refers to the accompanying drawings that show, by way of illustration, specific aspects and embodiments in which the present disclosed embodiments may be practiced. These embodiments are described in sufficient detail to enable those skilled in the art to practice aspects of the present invention. Other embodiments may be utilized, and changes may be made without departing from the scope of the disclosed embodiments. The various embodiments can be combined with one or more other embodiments to form new embodiments. The detailed description is, therefore, not to be taken in a limiting sense, and the scope of the present invention is defined only by the appended claims, with the full scope of equivalents to which they may be entitled. It will be appreciated by those of ordinary skill in the art that any arrangement that is calculated to achieve the same purpose may be substituted for the specific embodiments shown. This application is intended to cover any adaptations or variations of embodiments of the present invention. It is to be understood that the above description is intended to be illustrative, and not restrictive, and that the phraseology or terminology employed herein is for the purpose of description and not of limitation. Combinations of the above embodiments and other embodiments will be apparent to those of skill in the art upon studying the above description. The scope of the present disclosed embodiments includes any other applications in which embodiments of the above structures and fabrication methods are used. The scope of the embodiments should be determined with reference to the appended claims, along with the full scope of equivalents to which such claims are entitled.

What is claimed herein is:

1. An article of clothing adapted for use by a wearer having a torso, said article of clothing comprising:

(a) a body configured for covering at least a portion of the torso;

(b) a pair of openings, each said opening disposed on a side of said body; and (c) a first sleeve extending from a first opening of said pair of openings to form a first extension and a second sleeve extending from a second opening of said pair of openings to form a second extension, wherein said first extension is different from said second extension, one of said first extension and said second extension is no extension and one of said pair of openings is a finished non-fastening edge.

2. The article of clothing of claim 1, wherein said article of clothing is configured to cover the upper torso of the wearer.

3. The article of clothing of claim 2 is an article of clothing selected from the group consisting of a shirt, a blouse, a sweater, a jacket and any combinations thereof.

4. The article of clothing of claim 2, wherein one of said first extension and said second extension is upper arm-length extension.

5. The article of clothing of claim 4, wherein said upper arm-length extension is characterized by an extension having a ratio of a length of said upper arm-length extension over a full-sleeve length of about $1/8$ to about $7/24$.

6. The article of clothing of claim 2, wherein one of said first extension and said second extension is elbow-length extension.

7. The article of clothing of claim 6, wherein said elbow-length extension is characterized by an extension having a ratio of a length of said elbow-length extension over a full-sleeve length of about $7/24$ to about $11/24$.

8. The article of clothing of claim 2, wherein one of said first extension and said second extension is lower arm-length extension.

9. The article of clothing of claim 8, wherein said lower arm-length extension is characterized by an extension having a ratio of a length of said lower arm-length extension over a full-sleeve length of about $5/6$ to about $23/24$.

10. The article of clothing of claim 1, wherein said article of clothing is configured to cover the lower torso of the wearer.

11. The article of clothing of claim 10 is an article of clothing selected from the group consisting of a pair of pants, a pair of sweatpants and a combination thereof.

12. The article of clothing of claim 10, wherein one of said first extension and said second extension is upper leg-length extension.

13. The article of clothing of claim 12, wherein said upper leg-length extension is characterized by an extension having a ratio of a length of said upper leg-length extension over a full-sleeve length of about $1/5$ to about $11/35$.

14. The article of clothing of claim 10, wherein one of said first extension and said second extension is lower leg-length extension.

15. The article of clothing of claim 14, wherein said lower leg-length extension is characterized by an extension having a ratio of a length of said lower leg-length extension over a full-sleeve length of about $28/35$ to about $32/35$.

16. The article of clothing of claim 10, wherein one of said first extension and said second extension is knee-length extension.

17. The article of clothing of claim 16, wherein said knee-length extension is characterized by an extension having a ratio of a length of said knee-length extension over a full-sleeve length of about $12/35$ to about $16/35$.

18. An article of clothing adapted for use by a wearer having a torso, said article of clothing comprising:

(a) a body configured for covering at least a portion of the torso;

(b) a pair of openings, each said opening disposed on a side of said body;

(c) a first sleeve extending from a first opening of said pair of openings to form a first extension and a second sleeve extending from a second opening of said pair of openings to form a second extension, wherein said first extension is different from said second extension; and (d) a zipper configured to allow an opening of a less extended sleeve of said first sleeve and said second sleeve to be adjusted and a closure mechanism to removably secure said zipper in a desired state.

* * * * *